US006701852B2

(12) United States Patent
Sedge

(10) Patent No.: US 6,701,852 B2
(45) Date of Patent: Mar. 9, 2004

(54) COLLAPSIBLE MULTI-LEVEL PALLET

(76) Inventor: Peter Sedge, 3 Kingswood Road, Toronto, Ontario (CA), M4E 3N4

( * ) Notice: Subject to any disclaimer, the term of this patent is extended or adjusted under 35 U.S.C. 154(b) by 0 days.

(21) Appl. No.: 10/154,295

(22) Filed: May 23, 2002

(65) Prior Publication Data

US 2003/0154889 A1 Aug. 21, 2003

(30) Foreign Application Priority Data

Feb. 21, 2002 (CA) ..... 2372839

(51) Int. Cl.[7] ..... B65D 19/38
(52) U.S. Cl. ..... 108/54.1; 108/53.3
(58) Field of Search ..... 108/54.1, 53.5, 108/53.3, 53.1, 96, 164, 116, 99, 57.14

(56) References Cited

U.S. PATENT DOCUMENTS 544,821 A * 8/1895 Morrison ..... 108/116
2,927,702 A * 3/1960 Van Deusen, Jr. et al. ... 108/96
3,523,694 A * 8/1970 Oliver ..... 108/53.3
3,756,167 A * 9/1973 Wilson ..... 108/57.14
4,796,539 A * 1/1989 Berrett ..... 108/55.1
5,213,458 A * 5/1993 Preller et al. ..... 410/26
5,586,666 A * 12/1996 Squitieri ..... 108/54.1
5,771,815 A * 6/1998 Leftwich ..... 108/99
5,960,720 A * 10/1999 Borland et al. ..... 108/53.1
5,983,806 A * 11/1999 Brennan et al. ..... 108/53.1
6,067,913 A * 5/2000 Bennett ..... 108/53.5
6,173,659 B1 * 1/2001 Danks et al. ..... 108/54.1

FOREIGN PATENT DOCUMENTS

JP 6-92356 * 4/1994

* cited by examiner

*Primary Examiner*—Jose V. Chen
(74) *Attorney, Agent, or Firm*—Dinsmore & Shohl LLP

(57) ABSTRACT

A collapsible multi-level pallet having a collapsed position and an erected position includes a lower goods-supporting platform, an upper goods-supporting platform, a goods-supporting leaf and a plurality of legs. In the collapsed position, the upper goods-supporting platform, leaf and legs lay flat against the horizontal lower platform. The footprint of the collapsed apparatus is no greater than the footprint of the lower goods-supporting platform. In the erected position, the substantially vertical legs support the upper platform in a horizontal position above the lower platform, and the leaf is pivoted from the upper platform into a fixed position over the lower platform. The extended leaf is supported by a pair of deployable legs. A locking mechanism is used to lock the apparatus in the erected position. Goods may be loaded onto the upper and lower platforms of the erected pallet. The feet of the pallet are positioned and sized to define a volume beneath the lower platform into which at least part of the upper platform and leaf may be received when like pallets are stacked in their collapsed positions.

27 Claims, 6 Drawing Sheets

COLLAPSIBLE MULTI-LEVEL PALLET

FIELD OF THE INVENTION

The present invention relates to the field of pallets for transporting or storing goods.

BACKGROUND OF THE INVENTION

Pallets are often used for the purpose of transporting and storing goods in warehouses. Known pallets typically consist of a rectangular goods-supporting platform with feet which permit fork lift forks to pass underneath for lifting and transporting the pallet and its cargo.

Many warehouses employ rack or shelf systems to store pallets of goods at various heights within rack openings of a fixed height and width, with each rack opening being intended to store a single pallet of goods. To avoid wasting vertical space in a rack opening, it may be advantageous for the goods atop a pallet to be stacked in several layers. Such stacking is easily achieved when the goods are sturdy and of a uniform size and shape, because the top of each layer of goods forms a level platform for the next layer of goods. However, when the goods are oddly shaped, of non-uniform size, or fragile, such stacking may be impossible for reasons of instability or damage to goods. Disadvantageously, in such cases valuable rack opening space may be wasted.

What is needed is a pallet that overcomes the above-noted disadvantage, with the pallet further being collapsible to minimize storage space requirements when the pallet is not in use.

SUMMARY OF THE INVENTION

A collapsible multi-level pallet having a collapsed position and an erected position includes a lower goods-supporting platform and an upper goods-supporting platform. In the collapsed position, the upper goods-supporting platform lies flat over the lower platform. In the erected position, the upper platform is spaced from the lower platform. Goods may be loaded onto the lower and upper platforms of the erected pallet. A locking mechanism is used to lock the pallet in the erected position. An optional goods-supporting leaf is extendible from the raised upper platform into a position over the lower platform. The leaf may be supported in the extended position by deployable legs. The footprint of the pallet in its collapsed position is optionally no greater than the footprint of the lower platform.

In accordance with an aspect of the present invention there is provided a collapsible pallet comprising: a lower goods-supporting platform; an upper goods-supporting platform having a lowered position associated with a collapsed position of the pallet and a raised position associated with an erected position of the pallet, the upper platform being spaced from, and substantially parallel to, the lower platform when in the raised position so as to permit loading of goods onto the lower goods-supporting platform and the upper goods-supporting platform; and a first locking mechanism for locking the upper goods-supporting platform in the raised position.

In accordance with another aspect of the present invention there is provided a collapsible pallet comprising: lower goods-supporting platform means; upper goods-supporting platform means having a lowered position associated with a collapsed position of the pallet and a raised position associated with an erected position of the pallet, the upper platform means being spaced from, and substantially parallel to, the lower platform means when in the raised position so as to permit loading of goods onto the lower platform means and the upper platform means; and locking means for locking the upper goods-supporting platform means in the raised position.

In accordance with yet another aspect of the present invention, there is provided a collapsible pallet comprising: a lower goods-supporting platform; an upper goods-supporting platform having a lowered position associated with a collapsed position of the pallet and a raised position associated with an erected position of the pallet, the upper platform being spaced from, and substantially parallel to, the lower platform when in the raised position so as to permit loading of goods onto the lower goods-supporting platform and the upper goods-supporting platform; and a lock operatively coupled to at least one of the upper goods-supporting platform and the lower goods-supporting platform, the lock capable of selectively locking the upper goods-supporting platform in the raised position.

BRIEF DESCRIPTION OF THE DRAWINGS

In the figures which illustrate an example embodiment of this invention.

DETAILED DESCRIPTION

Figure 1:
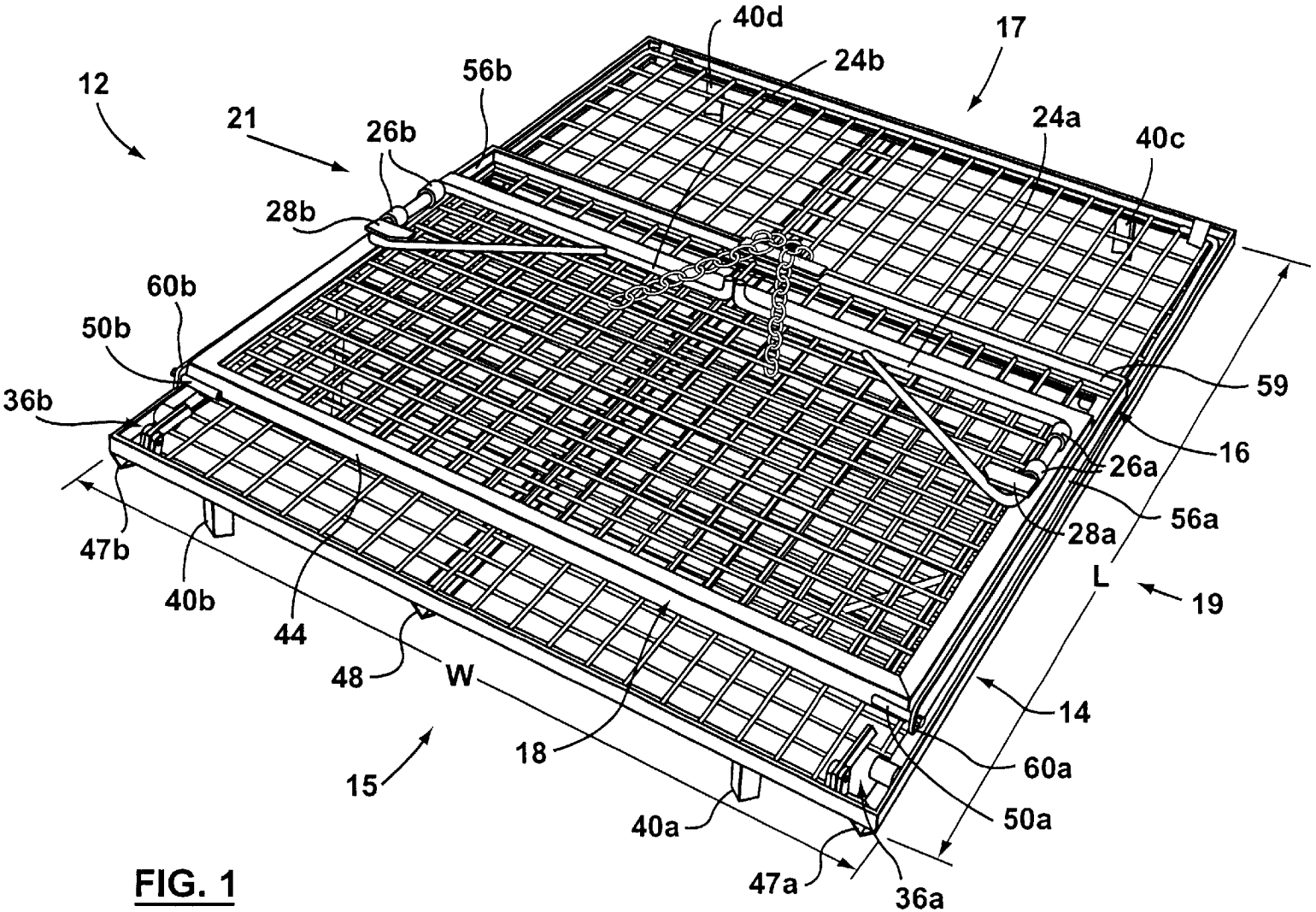
FIG. 1 is a perspective view of an embodiment of a multi-level pallet apparatus in a collapsed position.
Figure 2:
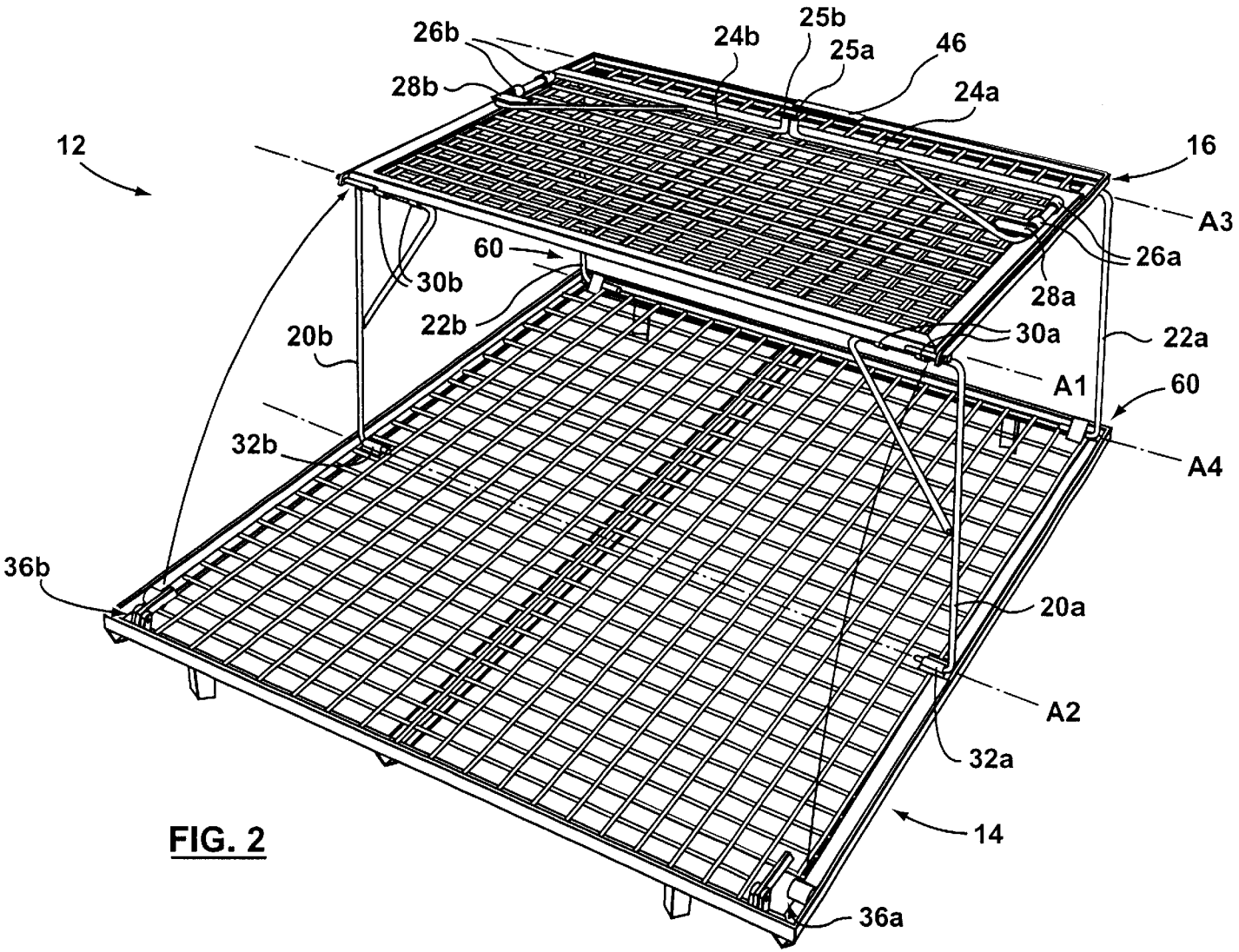
FIG. 2 is a perspective view of the embodiment of FIG. 1 in a partially erected position.
Figure 3:
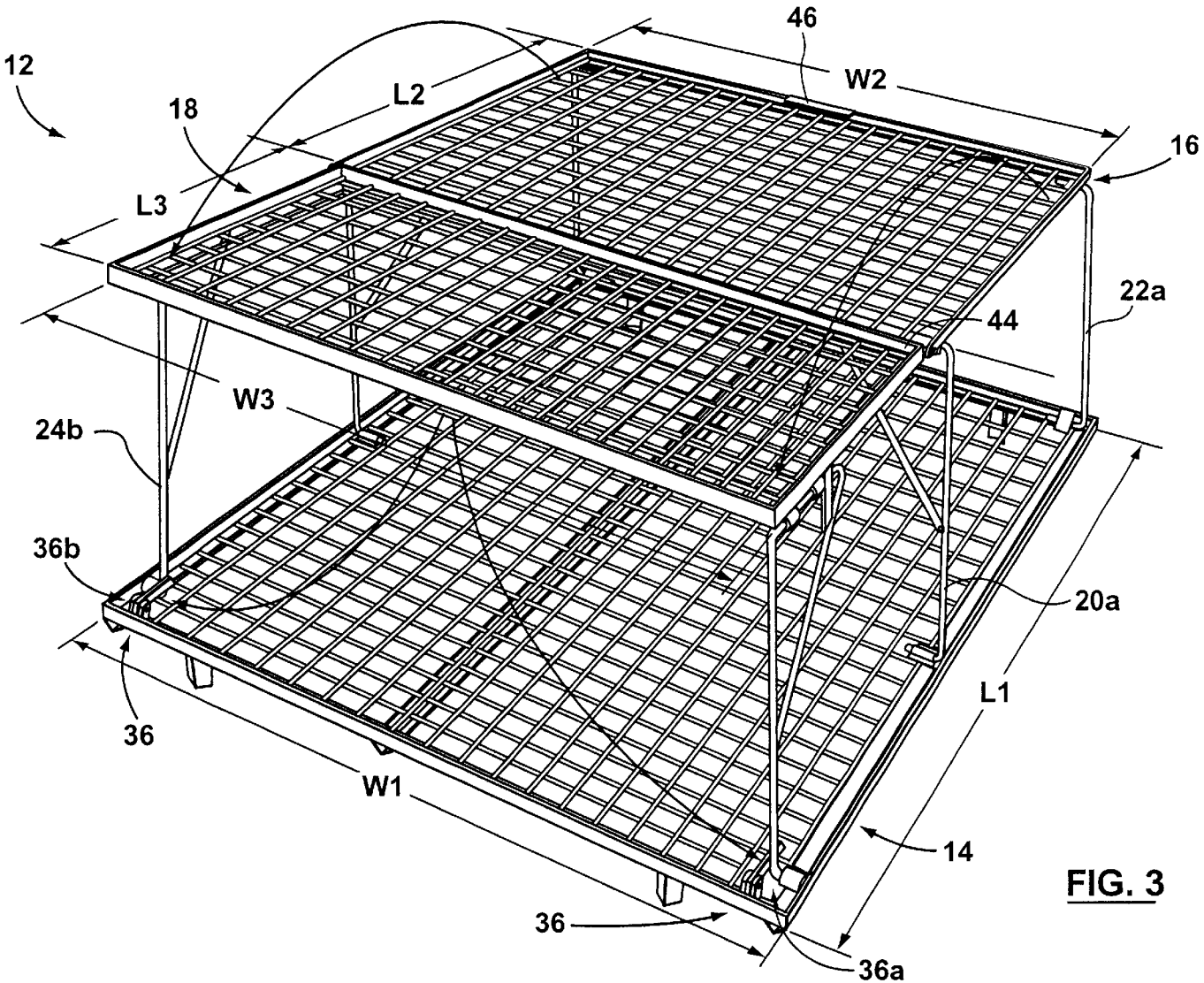
FIG. 3 is a perspective view of the embodiment of FIG. 1 in an erected position.
Figure 4:
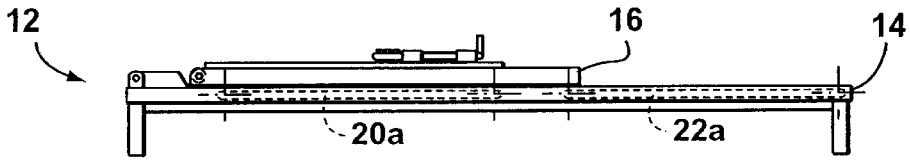
FIG. 4 is a side view of the embodiment of FIG. 1 in a collapsed position.
Figure 5:
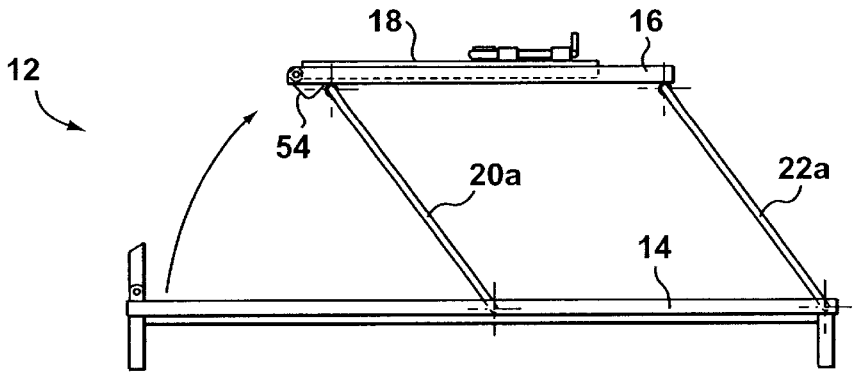
FIG. 5 is a side view of the embodiment of FIG. 1 in a partially erected position.
Figure 6:
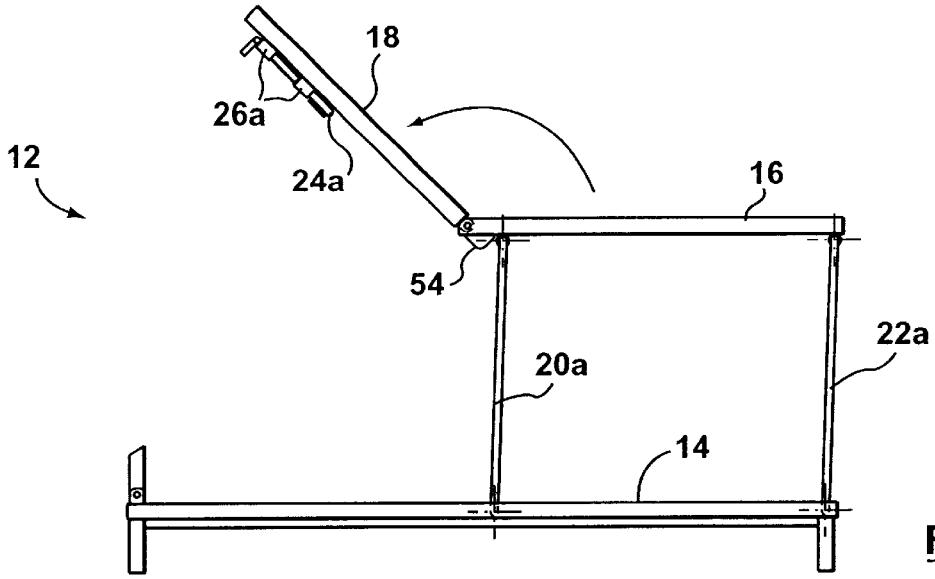
FIG. 6 is a side view of the embodiment of FIG. 1 in another partially erected position.
Figure 7:
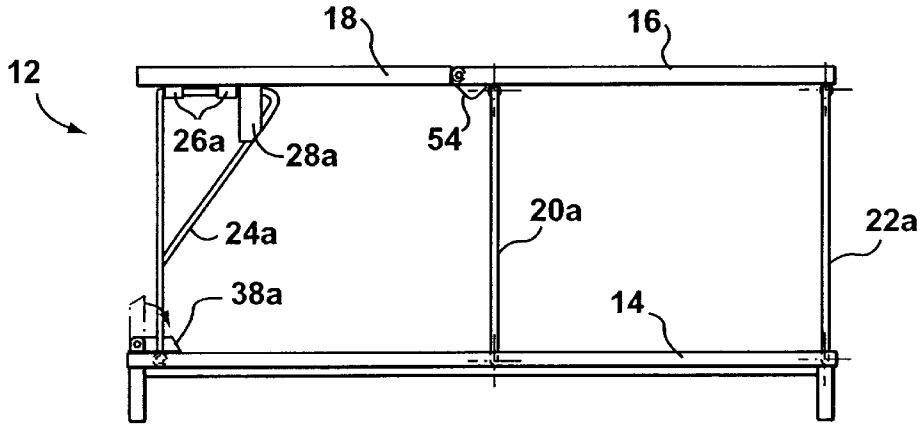
FIG. 7 is a side view of the embodiment of FIG. 1 in an erected position.
Figure 8:
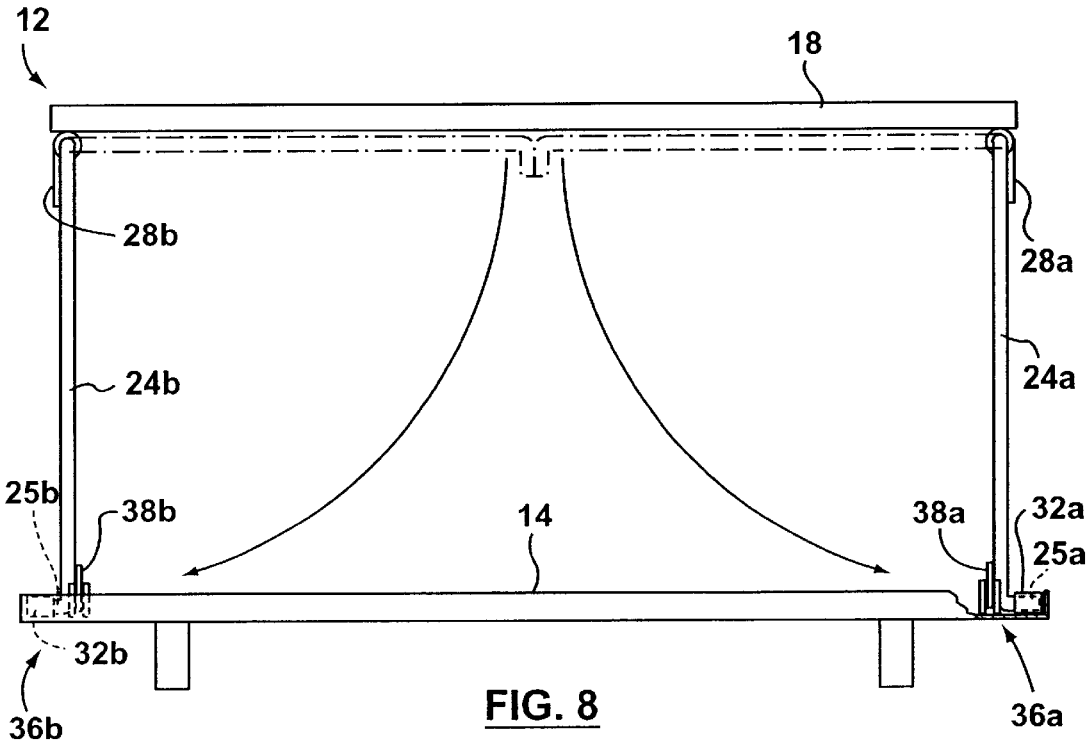
FIG. 8 is a front view of the embodiment of FIG. 1 in an erected position illustrating the embodiment's deployable legs.

Referring to FIGS. 1 to 8, an exemplary collapsible multi-level pallet 12 with two levels is illustrated at various stages of being erected. FIGS. 1 and 4 illustrate the pallet 12 in a collapsed position, FIGS. 2, 5 and 6 illustrate the pallet 12 in various partially erected positions, and FIGS. 3, 7 and 8 illustrate the pallet 12 in an erected position. As will be appreciated, the collapsed position is for storage of the pallet 12 when it is not in use while the erected position is for use of the pallet 12 to store or transport goods. The pallet 12 has a front 15, a rear 17, a right side 19 and a left side 21. It will be appreciated that the identification of the front, rear, and sides herein is for convenience of description only. In its collapsed position, the pallet 12 has a width W and a length L (FIG. 1).

The pallet 12 comprises two goods-supporting platforms, namely a lower platform 14 and an upper platform 16, which are each capable of supporting goods that may be loaded onto the pallet 12. In the present embodiment, each of these platforms 14 and 16 comprises a rectangular piece of steel mesh welded to a surrounding frame of angle-iron. In other embodiments, however, the platforms 14 and 16 may be made from other materials.

The frame of lower platform 14 comprises four angle iron members with "L-shaped" cross sections welded at their ends to form a rectangle. Each of the four members is oriented so that one half of the angle iron (i.e. the lower arm of the cross-sectional "L") extends towards the center of the rectangle and is substantially horizontal while the other half of the angle iron (i.e. the upper arm of the cross-sectional "L") extends upwardly from the horizontal portion at the perimeter of the frame. The lower platform 14 has a length L1 and a width W1 (FIG. 3).

The lower platform 14 includes a crossbar 48 (FIG. 1) welded lengthwise to the underside of its frame approximately equidistantly from the right and left sides 19 and 21. A pair of cross bars 47*a* and 47*b* are also welded to the underside of the frame of lower platform 14 lengthwise along its right side 19 and left side 21, respectively. The crossbars 48, 47*a* and 47*b* cumulatively increase the load-bearing capacity of lower platform 14 and serve as points of contact with fork lift forks that may be inserted transversely to the lower platform 14 for the purpose of lifting the pallet 12. In the present embodiment, the crossbar 48 and cross members 47*a* and 47*b* comprise sections of angle iron oriented with the corner pointing downwardly.

The lower platform 14 is supported by four feet 40*a*, 40*b*, 40*c* and 40*d* (FIG. 1) which provide sufficient clearance between the lower platform 14 and the floor for fork lift forks to be inserted under the pallet 12 for lifting and transporting the pallet and any goods loaded thereupon.

Upper platform 16 has a similar construction to lower platform 14 with the exception of its dimensions and the arrangement of its frame. With respect to its dimensions, the width W2 of the upper platform 16 (FIG. 3) is slightly less than the width W1 of lower platform 14, and the length L2 of the upper platform 16 is approximately 60% of the length L1 of lower platform 14 (as shown in FIG. 3).

The frame of upper platform 16 comprises four angle iron members with "L-shaped" cross sections welded at their ends to form a rectangle. Three of the four members, namely right member 56*a*, left member 56*b* and rear member 59 (FIG. 1), are arranged analogously to the members of the lower platform's frame. Front member 54 (FIGS. 5 to 7), on the other hand, is welded at its ends to the underside of right and left members 56*a* and 56*b* near their front ends with the corner of the angle iron pointing downwardly. As will become apparent, this arrangement of front member 54 permits a folding leaf 18 to be pivotably mounted along the front edge of the upper platform 16 so as to be extendible from its folded position (illustrated in FIGS. 1, 2, 4 and 5) to an unfolded or extended position (illustrated in FIGS. 3 and 7). A handle 46 suitable for grasping is centrally disposed on the rear angle iron member of upper platform 16 (FIGS. 2 and 3).

The upper arm of the cross-sectional "L" of the angle iron of sides 56*a* and 56*b* extends forwardly beyond the front member 54 to form brackets 60*a* and 60*b* respectively (FIG. 1). The brackets 60*a* and 60*b* each include a circular aperture for receiving a horizontal pin; the apertures are coaxial.

Four legs 20*a*, 20*b*, 22*a* and 22*b* (best seen in FIGS. 2, 3 and 5–7) interconnect the lower platform 14 and upper platform 16. In the present embodiment, the legs comprise steel rods. One end of legs 20*a* and 20*b* is pivotally mounted to the underside of upper platform 16 at its right and left front corners by way of bracket pairs 30*a* and 30*b* respectively to permit pivoting of the legs around transverse axis A1 (FIG. 2). The other end of each of legs 20*a* and 20*b* is pivotally connected at the edge of lower platform 14 by way of brackets 32*a* and 32*b* respectively so as to permit pivoting of the legs around transverse axis A2. Legs 22*a* and 22*b* are similarly mounted to the underside of upper platform 16 and to the upper surface of lower platform 14 at their right and left rear corners to permit pivoting of these legs around transverse axes A3 and A4 respectively.

As is visible in FIGS. 2 and 3, legs 20*a* and 20*b* of the present embodiment are mirror images of one another and are formed from a single steel rod bent back on itself to form a triangular upper portion which provides transverse stability to the pallet 12 when the upper platform 16 is raised. Legs 20*a*, 20*b* also have inwardly directed feet at their lower ends to provide interconnection points with the lower frame. Legs 22*a* and 22*b* are also mirror images of one another and comprise steel rods with feet at each end formed by bending the rods at right angles. The feet provide interconnection points with the upper platform 16 and lower platform 14. The legs 20*a*, 20*b*, 22*a* and 22*b* have a uniform length between their connection point with the lower platform and their connection point with the upper platform and provide a sufficient vertical separation between the lower platform 14 and upper platform 16 when the pallet 12 is erected for goods to be loaded onto lower platform 14. In the present embodiment, the length between connection points is also chosen so that, when the pallet 12 is collapsed, the horizontal displacement of the lowered upper platform 16 is not sufficient to cause the upper platform 16 to extend beyond the perimeter of lower platform 14 (thus, in the present embodiment, with the length L2 of the upper platform approximately 60% of the lower L1, the length of the legs 20*a*, 20*b*, 22*a* and 22*b* between their connection points is less than 40% of L1). This results in the footprint (i.e. length and width) of collapsed pallet 12 being no greater than the footprint of the lower platform 14. Space requirements for storing the collapsed pallet 12 may therefore be reduced. Advantageously, it may be possible to store collapsed pallets 12 within the same rack openings that may be used to store erected pallets 12 that are loaded with goods.

The pallet 12 further comprises a goods-supporting leaf 18 (FIG. 3). Leaf 18 comprises a rectangular frame of angle-iron welded to a steel mesh. The orientation of the angle iron members of the frame of leaf 18 when the pallet 12 is in its erected position (FIG. 3) is the same as orientation of the angle iron members of lower platform 14. The leaf 18 has a length L3 and a width W3 (FIG. 3). The combination of the length L3 of the leaf 18 and the length L2 of the upper platform 16 is substantially equal to the length L1 of the lower platform 14 so that, when the pallet 12 is erected, the cumulative length of the upper platform 16 and adjacent extended leaf 18 is substantially the same as the length L1 of the lower platform 14. The width W3 of the leaf 18 is slightly smaller than the width W2 of the upper platform 16 to permit the leaf 18 to be partially nested within the upper platform 16 when the leaf 18 is in its folded position, as best seen in FIG. 4.

Two pins 50*a* and 50*b* (FIG. 1) are welded to the rear edge 44 of leaf 18 (with "rear" referring to the position of the edge 44 when the leaf 18 is in its position shown in FIG. 3). The pins 50*a* and 50*b* are horizontal and coaxial as shown in FIG. 1 and are rotatably received by the apertures in brackets 60*a* and 60*b* respectively. The pins 50*a* and 50*b* define an axis of rotation about which the leaf 18 may be pivoted to move the leaf 18 from its stored position (FIGS. 1, 2, 4, and 5) to its extended position (FIGS. 3 and 7).

The leaf 18 of the present embodiment includes a pair of deployable legs 24*a* and 24*b* (FIGS. 1, 2, and 8). The legs 24*a* and 24*b* are mirror images of one another and are formed from a single steel rod bent back on itself to form a triangular upper portion which provides lengthwise stability to the pallet 12 when it is erected (FIG. 3). Each leg 24*a* and 24*b* has a foot 25*a* and 25*b* formed by bending the ends of the legs 24*a* and 24*b* at a right angle, with the feet 25*a* and 25*b* extending upwardly when the pallet 12 is in a collapsed position (FIG. 2). A pair of abutments 28*a* and 28*b* (FIGS. 1 and 2) welded to the frontward bend of the legs 24*a* and 24*b* respectively serve as limiters to prevent excessive outward pivoting of the legs, as will be described. The legs 24*a* and 24*b* are pivotally connected to the underside of leaf 18 at its right and left edges by way of bracket pairs 26*a* and 26*b*, with "underside" referring to the surface of the leaf 18 which faces downwardly when the pallet 12 is in its erected position. The brackets permit pivoting of these legs through a 90 degree angle (as shown in FIG. 8) around longitudinal axes that are substantially parallel to the right and left side of leaf 18, respectively. Notably the pivot axes of legs 24*a*, 24*b* are at a right angle to the pivot axes of each of legs 20*a*, 20*b*, 20*c* and 20*d*.

Figure 9:
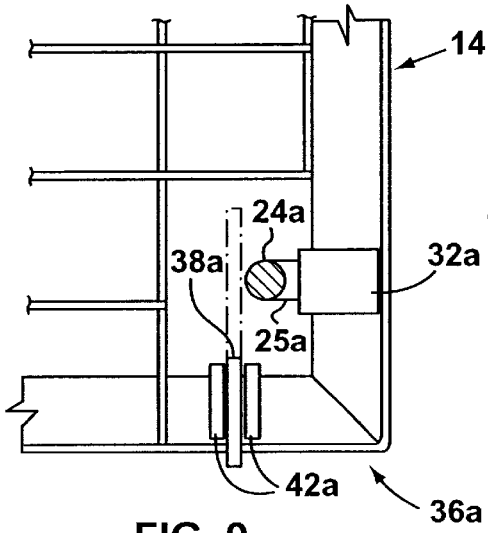
FIG. 9 is a top view of a locking mechanism of the embodiment of FIG. 1 in an unlocked position.
Figure 10:
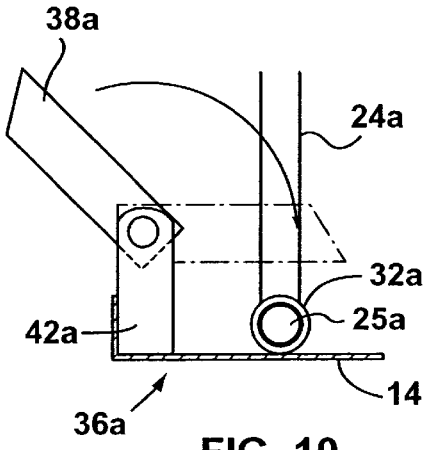
FIG. 10 is a side view of the locking mechanism illustrated in FIG. 8.

The lower platform 14 includes a pair of locking mechanisms 36*a* and 36*b* (cumulatively comprising first locking mechanism 36 of FIG. 3) situated in its right and left front corners respectively (FIGS. 1–3 and 8) which are used to lock the feet 25*a* and 25*b* into position when the legs 24*a* and 24*b* are deployed, as shown in FIG. 8 for example. Enlarged top and side views of mechanism 36*a* are provided in FIGS. 9 and 10 respectively. The mechanism 36*a* comprises annular member 32*a* capable of receiving foot 25*a* when the leg 24*a* is deployed. The mechanism further comprises a bracket 42*a* pivotably supporting a retaining bar 38*a* capable of pivoting between an open position (illustrated in FIGS. 9 and 10) and a closed position (illustrated in FIGS. 3 and 7). When the retaining bar is in the open position, the foot 25*a* may be freely inserted into or removed from the annular member 32*a* through rotation of the leg 24*a* (as shown in FIG. 8). When the retaining bar 38*a* is in the closed position, removal of the inserted foot is prevented. The other locking mechanism 36*b* is a mirror image of mechanism 36*a*.

A second locking mechanism comprising a chain 80 (FIG. 1) selectively tethers leaf 18 of the collapsed pallet 12 to lower platform 14. The two ends of chain 80 are unremovably affixed to the steel mesh of the leaf 18 so as to leave slack in the chain 80. The middle of the slackened chain 80 may be pulled over the legs 24*a* and 24*b* of leaf 18 (forming the chain 80 into a "V" shape) and secured to the lower platform 14 with a clip (not shown) which forms part of the chain. The clip may be a conventional key ring attached to the middle of the chain 80 for example. When secured, the chain 80 maintains the pallet 12 in its collapsed position even when the pallet 12 it is set on its edge or inverted. The secured chain 80 overlays legs 24*a* and 24*b* of leaf 18 to maintain them in their undeployed positions.

In operation, a person desirous of using the multi-level pallet 12 sets the collapsed pallet onto a hard surface as shown in FIG. 1. The middle of chain 80 is detached from the lower platform 14 to release the upper platform 16 and leaf 18. The middle of the chain 80 may then be pulled towards the front of the pallet 12 to take up any slack and attached to the mesh to the leaf 18 to prevent dangling of the chain 80 when the pallet 12 is erected. Advantageously, because the chain is not detached from the pallet 12, it does not have a tendency to become lost.

Standing at the rear 17 (FIG. 1) of the pallet 12, the user grasps the handle 46 at the rear of upper platform 16 and pulls upwardly and rearwardly. This causes the upper platform 16 and folded leaf 18 to be translated upwardly and rearwardly away from lower platform 14 (FIG. 5) to the partially erected position shown in FIG. 2. During translation, the legs 20*a*, 20*b*, 22*a* and 22*b* pivot from their horizontal collapsed positions (FIG. 4) about axes A2 and A4 until a lower rearward portion of legs 22*a* and 22*b* abuts the upstanding portion of the rear angle iron member of lower platform 14 at abutment point 60 (FIG. 2). At abutment point 60, the legs 22*a* and 22*b* (as well as legs 20*a* and 20*b*) are inclined slightly beyond the vertical in the rearward direction. This permits the pallet 12 to rest in the partially erected state shown in FIG. 2 without being held by the user.

The user subsequently pivots the leaf 18 (as shown in FIG. 6) through an angle of 180 degrees until it achieves an extended position in which it is coplanar with raised upper platform 16. With the assistance of gravity, the legs 24*a* and 24*b* of leaf 18 pivot downwardly through a 90 degree angle about bracket pairs 26*a* and 26*b* to a substantially vertical deployed position as shown in FIG. 8. Excessive outward pivoting of the legs 24*a* and 24*b* is prevented by contact between abutments 28*a* and 28*b* and the underside of the frame of unfolded leaf 18 (FIG. 8). With the retaining bars 38*a* and 38*b* in their open positions, the feet 25*a* and 25*b* of legs 24*a* and 24*b* are inserted into annular members 32*a* and 32*b* of first locking mechanism 36. The retaining bars 38*a* and 38*b* are then closed (as shown in FIG. 7) to prevent removal of the feet 25*a* and 25*b*. Because the pivot axes of feet 24*a*, 24*b* are not parallel with those of legs 20*a* to 20*d*, with the feet anchored in the annular members 32*a* and 32*b*, the pallet 12 is locked in the erected position (FIG. 3). Advantageously, the pallet 12 may be erected by a single user.

Once erected, both levels of the pallet 12 may be loaded with goods. In the present embodiment, the goods are preferably loaded from the front 15 or back 17 of the pallet 12 to facilitate positioning of the goods on the upper surface 16, leaf 18 and lower platform 14 through sliding. Lengthwise sliding is facilitated by the parallel alignment of the wires comprising the upper surface of the mesh of upper platform 16, leaf 18 and lower platform 14 in a lengthwise direction. Loading of goods from the sides of pallet 12 is also possible but may be more difficult due to increased sliding resistance in a transverse direction presented by the broad side of the lengthwise wires. Of course, in an alternative embodiment the mesh of the upper platform 16, leaf 18 and lower platform 14 may be rotated by 90 degrees to facilitate transverse loading instead of lengthwise loading.

Advantageously, at least two layers of goods (one per pallet level) may be loaded onto the erected pallet 12, even when goods cannot be stacked due to being oddly shaped, of non-uniform size, or fragile.

Disassembly of the unloaded pallet 12 is achieved by performing the above described assembly steps in reverse order.

It will be appreciated that all parts are integral to the pallet. This is advantageous in that it reduces the risk of lost components.

Figure 11:
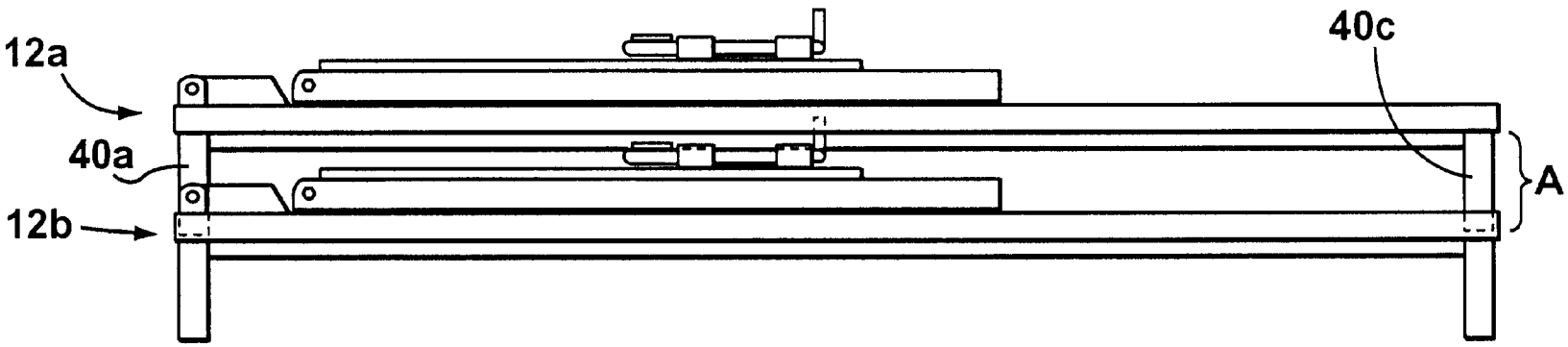
FIG. 11 is a side view illustrating the stacking of multiple collapsed pallets.

For convenient storage, multiple collapsed pallets 12*a* and 12*b* may be stacked as shown in FIG. 11. When stacked, the feet 40*a*–40*d* of an upper pallet 12*a* rest on the angle iron members of lower platform 14 of the underlying pallet 12*b*. Horizontal displacement of the upper pallet 12*a* is limited by the upstanding perimeter of pallet 12*b*'s lower platform frame. Moreover, the feet 40*a*–40*d* of the upper pallet 12*a* define a volume A beneath that pallet's lower platform 14 into which at the upper platform 16, leaf 18 and deployable legs 24*a* and 24*b* of the lower pallet 12*b* are received. Advantageously, the height of stacked pallets is thereby diminished, reducing storage space requirements.

As will be appreciated by those skilled in the art, modifications to the above-described embodiment can be made without departing from the essence of the invention. For example, the lower platform 14, upper platform 16, and leaf 18 need not be comprised of steel mesh welded into an angle iron frame. Any rigid flat goods-supporting surface may be used.

Different locking mechanisms than those described herein may be used in alternative embodiments. For example, instead of the first locking mechanism 36 (FIG. 3), the free ends of legs 24*a* and 24*b* may each comprise a nub which may be passed through a wide end of a narrowing, horizontally oriented slot in the right and left frame member (respectively) of lower platform 14. When the free ends of the legs 24*a* and 24*b* are slid along the slot, the narrowed width of the slot prevents removal of the nub and the leg end is thereby secured, in an analogous manner to the chain-lock mechanism commonly used to chain residential doors for example.

Some embodiments may not include a leaf 18. In such leafless embodiments, the upper platform 16 may have a footprint that is less than the footprint of the lower platform 14, resulting in a portion of the pallet 12 being bi-level and the remainder of the pallet 12 being uni-level. This type of arrangement may be desired in cases where tall goods are to be stored alongside short goods, as the tall goods may be loaded onto the uni-level portion of the pallet 12 and the short goods may be loaded onto either level of the bi-level portion. Alternatively, the upper platform 16 may have an extent that is the same as lower platform 14. In this case, the erected pallet will be entirely bi-level, however, the extent of the collapsed pallet will exceed the extent of the lower platform 14. In either case, the absence of a leaf 18 will necessitate a change in the mechanism used to lock the pallet 12 in the erected position, as the described anchor point for the deployable legs 24*a* and 24*b* (the underside of the leaf 18) will not exist. In one alternative, the deployable legs 24*a* and 24*b* may be attached to the underside of the upper platform 16 rather than under the leaf 18 using the brackets 26*a* and 26*b*, in which case the locking mechanisms 36*a* and 36*b* may be relocated underneath brackets 26*a* and 26*b* (respectively) to facilitate locking. In another alternative, in place of deployable legs 24*a* and 24*b* and mechanism 36, a simple bracket and pivotable retaining bar analogous to bracket 42*a* and retaining bar 38*a* of FIGS. 9 and 10 may be situated at the right and left sides 19 and 21 (FIG. 1) of lower platform 14, with the axis of rotation of the retaining bars being longitudinal. When in the closed position, the retaining bars may abut the front side of legs 20*a* and 20*b* of the erected pallet 12 and thus lock the pallet 12 in the erected position. When in the open position, the front side of legs 20*a* and 20*b* is unobstructed and the pallet 12 may be collapsed.

In another alternative, the leaf 18 may not be pivotably connected to the upper platform 16. Rather, the leaf 18 may be extendable from upper platform 16 in another manner. For example, the leaf 18 may be telescopingly connected to upper platform 16 so as to be extendible from the raised upper platform 16 through the application of horizontal pulling force onto the leaf 18. Such alternative leaf 18 arrangements may or may not include deployable legs. For example, a telescoping leaf 18 may employ a mechanism similar to an oven rack system to support the leaf 18 when extended. That is, the upper platform 14 may include, for example, a horizontal slot with upturned ends in its right and left frame members which each receive a pin protruding laterally from the leaf 18, and the upper platform 14 may have suitable surrounding structure, so that when the front of the leaf 18 is raised, the laterally protruding pins are lowered from the rear slot ends, and the leaf 18 may be pulled forwardly in the inclined position until, by dropping the front of the leaf 18 to make the leaf 18 once again horizontal, the pins slide into the upturned front slot ends, and the leaf 18 is thus locked in the extended position.

Also, while the present embodiment is capable of standing in a partially erected state as shown in FIG. 6 due to the abutment of the legs 22*a* and 22*b* against the upstanding rear edge of lower platform 14 at abutment points 60 (FIG. 2), it is not necessary to include this feature in alternative embodiments. Of course, it may be difficult for a single individual to assemble or disassemble such embodiments.

As well, it is not necessary for all parts of the pallet 12 to be permanently joined. However, the use of separate parts may be disadvantageous in that such parts may become separated from the pallet and may become lost.

Finally, though the exemplary multi-level pallet 12 is illustrated herein as a bi-level pallet, it will be appreciated that the pallet 12 may be implemented with more than two levels. For example, a third "middle" platform may be affixed at the midpoint of the legs 20*a*, 20*b*, 22*a*, and 22*b* by way of pivotal connections so as to permit the platform to be sandwiched between the upper and lower platforms 16 and 14 when the pallet 12 is collapsed, and so that the middle platform is horizontally supported at the midpoint of legs 20*a*, 20*b*, 22*a* and 22*b* when the pallet 12 is erected. Alternatively, in a leafless embodiment, an additional third level may be added above the upper platform 16. More specifically, the mechanism which attaches the lower platform 14 to the upper platform 16 may be reproduced at upper platform 16 to collapsibly support a third, uppermost platform. In such an embodiment, an alternative first locking mechanism to mechanism 36, as described above with respect to the leafless embodiment, may be employed.

Other modifications will be apparent to those skilled in the art and, therefore, the invention is defined in the claims.

What is claimed is:

1. A collapsible pallet comprising:

(a) a lower goods-supporting platform;

(b) an upper goods-supporting platform having a lowered position associated with a collapsed position of said pallet and a raised position over said lower goods-supporting platform associated with an erected position of said pallet, said upper platform being spaced from, and substantially parallel to, said lower platform when in said raised position so as to permit loading of goods onto said lower goods-supporting platform and said upper goods-supporting platform, said upper goods-supporting platform in said raised position being spaced from said lower goods-supporting platform by a distance that is substantially greater than a distance between said lower goods-supporting platform and a surface upon which said pallet rest, said upper goods-supporting platform laying substantially flat over, and substantially within a perimeter of, said lower goods-supporting platform when in said lowered position; and (c) a first locking mechanism for locking said upper goods-supporting platform in said raised position.

2. The pullet of claim 1 further comprising:

(d) a goods-supporting leaf extendible from said upper goods-supporting platform into a fixed position over said lower platform when said upper platform is in said raised position.

3. The pallet of claim 2 wherein said extendible leaf so pivotably connected to said upper platform.

4. The pallet of claim 2 further comprising at least one deployable leg for supporting said leaf in said extended position.

5. The pallet of claim 4 wherein said at least one deployable leg is pivotally connected to one of said leaf and said lower platform and further comprising at least one lock at the other of said leaf and said lower platform for locking in a deployed position, said deployable leg and said lock comprising said first locking mechanism.

6. The pallet of claim 5 wherein said at least at one deployable leg is pivotably mounted to said one of said lower platform and said leaf so as to have a non-parallel pivot axis with said plurality of rigid legs.

7. The pallet of claim 6 wherein said at least one lock comprises a receptable for receiving a free end of said deployable leg.

8. The pallet of claim 7 wherein said lock comprises a retaining bar movable between an open and closed position, said retaining bar permitting removal of said free end of said at least one deployable leg from said receptable when in the open position, said abutment obstructing the removal of said free end of said at least one deployable leg from said receptable when in the closed position.

9. The pallet of claim 2 further comprising a plurality of rigid legs pivotally connected at one end to said upper platform and at another end to said lower platform, said pivotal connections permitting movement of said upper platform between said lowered position and raised position.

10. The collapsible pallet of claim 9 wherein said pivotal connections have parallel pivot axes.

11. The collapsible pallet of claim 10 further comprising an abutment extending from said lower platform abutting one of said legs when said legs have pivoted just past a vertical position, such that said collapsible pallet is self-standing.

12. The pallet of claim 2 further comprising a plurality of feet depending from said lower platform said feet being positioned and sized so as to define a volume beneath said lower platform into which at least part of the upper platform and leaf of a like pallet may be received when the pallets are stacked in their collapsed positions.

13. The pallet of claim 2 further comprising a second locking mechanism for maintaining said pallet in said collapsed position regardless of an orientation of said collapsed pallet.

14. The pallet of claim 13 wherein said second locking mechanism is a detachable tether securing said lower goods-supporting platform to either one or both of said upper goods-supporting platform and said extendible leaf.

15. The pallet of claim 14 wherein said tether is a chain.

16. The apparatus of claim 2 wherein said lower platform and said upper platform with extended leaf are approximately co-extensive.

17. The pallet of claim 2 wherein said leaf and said upper platform are at least partially nested when said pallet is in the collapsed position.

18. The pallet of claim 1 further comprising a plurality of feet depending from said lower platform, said feet being positioned and sized so as to define a volume beneath said lower platform into which at least part of the upper platform of a like pallet may be received when the pallets are stacked in their collapsed positions.

19. The pallet of claim 1 wherein said first locking mechanism is integral with said pallet.

20. The pallet of claim 1 wherein each of said lower platform and said upper platform comprises a welded metal mesh mounted within an angle iron frame.

21. The pallet of claim 20 wherein the wires comprising an upper surface of said mesh of said lower platform and the wires comprising an upper surface of said upper platform are substantially parallel to each other.

22. A collapsible pallet comprising:

(a) lower goods-supporting platform means;

(b) upper goods-supporting platform means having a lowered position associated with a collapsed position of said pallet and a raised position over said lower platform means associated with an erected position of said pallet, said upper platform means being spaced from, and substantially parallel to said lower platform means when in said raised position so as to permit loading of goods onto said lower platform means and said upper platform means said upper platform means in said raised position being spaced from said lower platform means by a distance that is substantially greater than a distance between said lower platform means and a surface upon which said pallet rests said upper platform means laying substantially flat over, and substantially within a perimeter of, said lower platform means when in said lowered position; and (c) locking means for locking said upper goods-supporting platform means in said raised position.

23. The pallet of claim 22 further comprising:

(d) goods-supporting leaf means extendible from said upper goods-supporting platform means into a fixed position over said lower platform means when said upper platform means is in said raised position.

24. The pallet of claim 22 wherein said upper platform means and extended leaf means are substantially within said perimeter of said lower platform means when said pallet is in said erected position.

25. A collapsible pallet comprising:

(a) a lower goods-supporting platform;

(b) an upper goods-supporting platform having a lowered position associated with a collapsed position of said pallet and a raised position over said lower goods-supporting platform associated with an erected position of said pallet, said upper platform being spaced from, and substantially parallel top said lower platform when in said raised position so as to permit loading of goods onto said lower goods-supporting platform and said upper goods-supporting platform, said upper goods-supporting platform in said raised position being spaced from said lower goods-supporting platform by a distance that is substantially greater than a distance between said lower goods-supporting platform and a surface noon which said pallet rests, said upper goods-supporting platform laying substantially flat over, and sub substantially within a perimeter of, said lower goods-supporting platform when in said lowered position; and (c) a lock operatively coupled to at least one of said upper goods-supporting platform and said lower goods-supporting platform, said lock capable of selectively locking said upper goods-supporting platform in said raised position.

26. The pallet of claim 25 said upper platform and extended leaf are substantially within said perimeter of said lower platform when said pallet is in said erected position.

27. The pallet of claim 1 wherein said upper platform and extended leaf are substantially within said perimeter of said lower platform when said pallet is in said erected position.

* * * * *

UNITED STATES PATENT AND TRADEMARK OFFICE

CERTIFICATE OF CORRECTION

PATENT NO. : 6,701,852 B2
DATED : March 9, 2004
INVENTOR(S) : Peter Sedge

It is certified that error appears in the above-identified patent and that said Letters Patent is hereby corrected as shown below:

Column 2,
Line 27, insert -- Other aspects and features of the present invention will become apparent to those ordinarily skilled in the art upon review of the following description of specific embodiments of the invention in conjunction with the accompanying figures. --

Column 9,
Line 29, delete "over said lower goods-"
Line 30, delete "supporting platform"
Line 31, insert -- over, substantially within a perimeter of, -- after "from,"
Line 46, replace "pullet" with -- pallet --
Lines 54-56, replace "The pallet of claim 2 further comprising at least one deployable leg for supporting said leaf in said extended postion." with
-- A collapsible pallet comprising:
(a) a lower goods-supporting platform;
(b) An upper goods-supporting platform having a lowered position associated with a collapsed postion of said pallet and a raised position associated with an erected position of said pallet, said upper platform --

Signed and Sealed this

Twenty-second Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,701,852 B2
DATED : March 9, 2004
INVENTOR(S) : Peter Sedge

It is certified that error appears in the above-identified patent and that said Letters Patent is hereby corrected as shown below:

Column 2,
Line 27, insert -- Other aspects and features of the present invention will become apparent to those ordinarily skilled in the art upon review of the following description of specific embodiments of the invention in conjunction with the accompanying figures. --.

Column 9,
Line 29, delete "over said lower goods-".
Line 30, delete "supporting platform".
Line 31, insert -- over, substantially within a perimeter of, -- after "from,".
Line 46, replace "pullet" with -- pallet --.
Lines 54-56, replace "The pallet of claim 2 further comprising at least one deployable leg for supporting said leaf in said extended postion." with
-- A collapsible pallet comprising:
(a) a lower goods-supporting platform;
(b) An upper goods-supporting platform having a lowered position associated with a collapsed postion of said pallet and a raised position associated with an erected position of said pallet, said upper platform
being spaced from, and substantially parallel to, said lower platform when in said raised position so as to permit loading of goods onto said lower goods-supporting platform and said upper goods-supporting platform;
(c) a first locking mechanism for locking said upper goods-supporting platform in said raised position;
(d) a goods-supporting leaf extendible from said upper goods-supporting platform into a fixed position over said lower platform when said upper platform is in said raised position;
and further comprising at least one deployable leg for supporting said leaf in an extended position.--.

Column 11,
Line 1, delete "over said lower plat-".
Line 2, delete "form means".
Line 3, insert -- over, substantially within a perimeter of, -- after "from,".
Line 4, insert -- , -- after "to".
Line 11, insert -- , -- after "rests".

UNITED STATES PATENT AND TRADEMARK OFFICE

CERTIFICATE OF CORRECTION

PATENT NO. : 6,701,852 B2
DATED : March 9, 2004
INVENTOR(S) : Peter Sedge

It is certified that error appears in the above-identified patent and that said Letters Patent is hereby corrected as shown below:

Column 12,
Line 1, delete "over said lower goods-".
Line 2, delete "supporting platform".
Line 3, insert -- over, substantially within a perimeter of, -- after "from,".
Line 4, replace "top" with -- to --.
Line 15, delete "sub".
Line 24, insert -- wherein -- after "25".

This certificate supersedes Certificate of Correction issued March 22, 2005.

Signed and Sealed this

Twenty-first Day of March, 2006

JON W. DUDAS
*Director of the United States Patent and Trademark Office*